US012245669B1

(12) United States Patent
Mukhamejanov et al.

(10) Patent No.: US 12,245,669 B1
(45) Date of Patent: Mar. 11, 2025

(54) CUSTOMIZABLE STICKY TRANSPARENT BRACELET

(71) Applicants: Yeltay Mukhamejanov, Almaty (KZ); Zhanna Eva Mukhamejan, Almaty (KZ)

(72) Inventors: Yeltay Mukhamejanov, Almaty (KZ); Zhanna Eva Mukhamejan, Almaty (KZ)

( * ) Notice: Subject to any disclaimer, the term of this patent is extended or adjusted under 35 U.S.C. 154(b) by 0 days.

(21) Appl. No.: 18/924,914

(22) Filed: Oct. 23, 2024

(51) Int. Cl.
*A44C 5/00* (2006.01)
*A44C 27/00* (2006.01)

(52) U.S. Cl.
CPC ..... *A44C 5/0007* (2013.01); *A44C 5/0053* (2013.01)

(58) Field of Classification Search
CPC ..... A44C 15/003; A44C 5/0084; A44C 5/12; A44C 9/0076; A44C 5/00; A44C 5/0007; A44C 5/0053; A44C 5/0092; A44C 9/0061; A44C 9/0053; A44C 15/00; A44C 17/0208; A44C 25/00; A44C 25/007; A45F 2005/008; Y10T 24/1368; A47L 25/005
USPC ..... 63/3, 11, 21, 23, 40
See application file for complete search history.

(56) References Cited

U.S. PATENT DOCUMENTS

| | | | | | |
|---|---|---|---|---|---|
| 4,809,416 | A * | 3/1989 | Poltash | A44C 27/00 | 428/21 |
| 5,742,969 | A * | 4/1998 | Thomas | A47L 25/005 | 15/104.002 |
| 6,065,242 | A * | 5/2000 | Weder | B44F 1/10 | 40/594 |
| 2001/0031322 | A1* | 10/2001 | Sloot | A44C 5/0084 | 428/17 |
| 2007/0022550 | A1* | 2/2007 | McLeod | A47L 25/005 | 15/104.002 |
| 2012/0186121 | A1* | 7/2012 | Hanssen | A44C 5/0053 | 40/633 |
| 2013/0074545 | A1* | 3/2013 | Moloney | A44C 25/007 | 63/3 |
| 2015/0257498 | A1* | 9/2015 | White | A44C 25/007 | 24/3.1 |
| 2019/0289968 | A1* | 9/2019 | Hunter | A44C 15/0065 | |

* cited by examiner

*Primary Examiner* — Jack W Lavinder
(74) *Attorney, Agent, or Firm* — CM Law PLLC; Robert C. Klinger

(57) ABSTRACT

A user customizable bracelet having a sticky outer surface mostly or completely about the bracelet. A protective layer protects the outer sticky surface when not in use and is removable to expose the outer sticky surface. Decorative objects can be selectively attached to the sticky outer surface such that the bracelet is customizable by a user, such as young children. The objects can include small objects like flowers, small toys, or other tiny items to enable children (and adults) to personalize the bracelet. The bracelet is inexpensive and may be packaged in a kit including the covered bracelet and an assortment of objects to choose from. The bracelet is also disposable after use or even lost and provides entertainment to kids needing to focus on a project.

18 Claims, 4 Drawing Sheets

CUSTOMIZABLE STICKY TRANSPARENT BRACELET

TECHNICAL FIELD

The present disclosure relates to wearable accessories, including but not limited to children's bracelets.

BACKGROUND

Bracelets for children, as well as adults, are configured to be worn around a user's wrist and form a wearable accessory.

DETAILED DESCRIPTION

This disclosure includes a user customizable bracelet having a sticky outer surface mostly or completely about the bracelet. A protective layer protects the outer sticky surface when not in use and is removable to expose the outer sticky surface. Decorative objects can be selectively attached to the sticky outer surface such that the bracelet is customizable by a user, such as young children. The objects can include small objects like flowers, small toys, or other tiny items to enable children (and adults) to personalize the bracelet. The bracelet is inexpensive and may be packaged in a kit including the covered bracelet and an assortment of objects to choose from. The bracelet is also disposable after use or even lost and provides entertainment to kids needing to focus on a project.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and circuitry have been described at a relatively high-level, without detail, in order to avoid unnecessarily obscuring aspects of the present teachings.

The term "coupled" as used herein refers to any logical, optical, physical or electrical connection, link or the like by which signals, or light produced or supplied by one system element are imparted to another coupled element. Unless described otherwise, coupled elements or devices are not necessarily directly connected to one another and may be separated by intermediate components, elements or communication media that may modify, manipulate or carry the light, sound, or signals.

Figure 1:
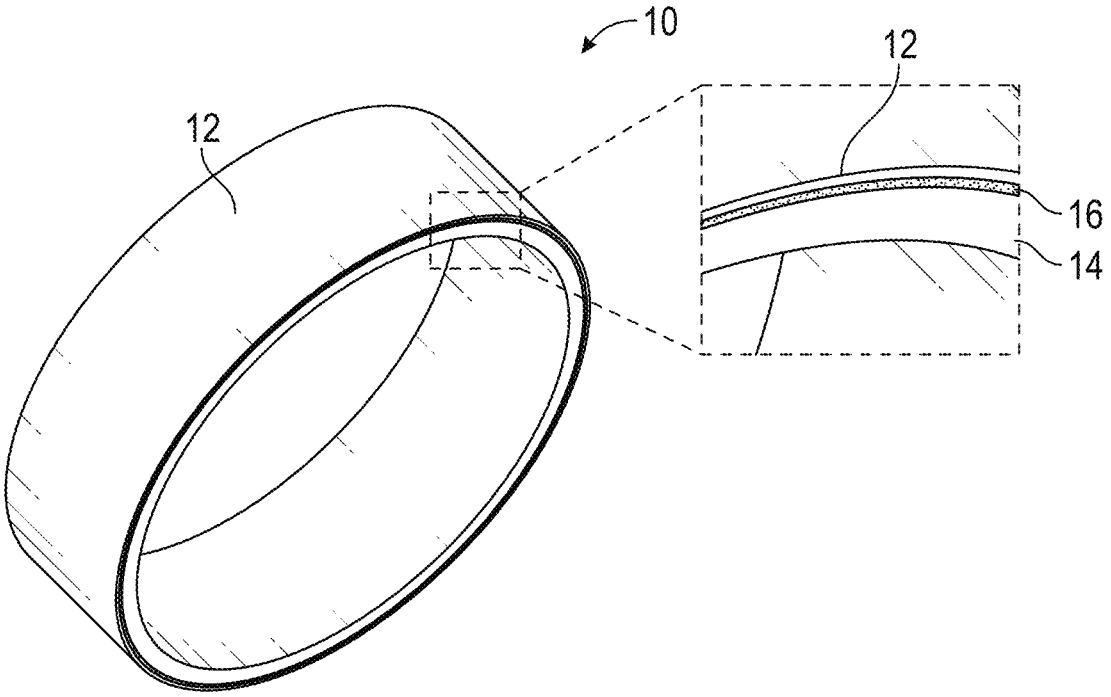
FIG. 1 is a perspective view of a bracelet having an outer surface that is significantly or completely sticky around the circumference of the bracelet.
Figure 2:
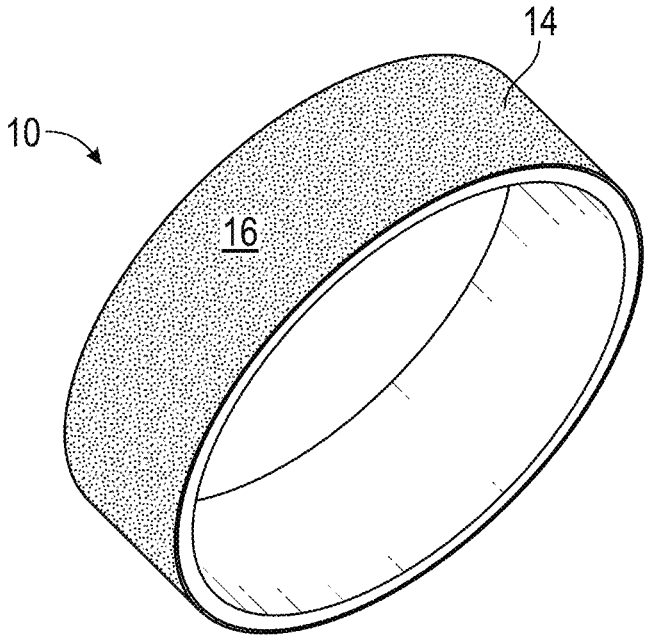
FIG. 2 is a perspective view of the bracelet of FIG. 1 including a user removable protective layer covering the sticky outer surface.

Referring to FIG. 1 there is shown a perspective view of an annular bracelet 10 comprising a band having a user removable protective layer 12 disposed significantly or completely around an outer surface 14 of the bracelet. As illustrated in FIG. 2, the outer surface 14 is a major surface having a length and width, such as a rectangular surface, and is coated with a transparent sticky material 16, such as a tacky substance like an adhesive or glue that is safe for humans including children. Sticky material is available from numerous commercial sources such as 3M Corporation of St. Paul, Minnesota. The sticky material 16 may glisten or shine, and may have glitter for a sparkly appearance. The outer surface 14 can also include text, symbols, designs and other types of indicia. The protective layer 12 ensures the sticky surface 14 remains clean and safe until the child decides to use it. Bracelet 10 can be formed of a unitary material, such as a paper, plastic or elastic member such as rubber or silicone forming an annular ring. In another embodiment shown in FIG. 6, FIG. 7 and FIG. 8, bracelet 10 can be formed as a single strip of material that is wrapped around a user's wrist and stuck to itself by sticky material 16 to provide a diameter with a user customizable dimension and fit a wrist comfortably.

Figure 3:
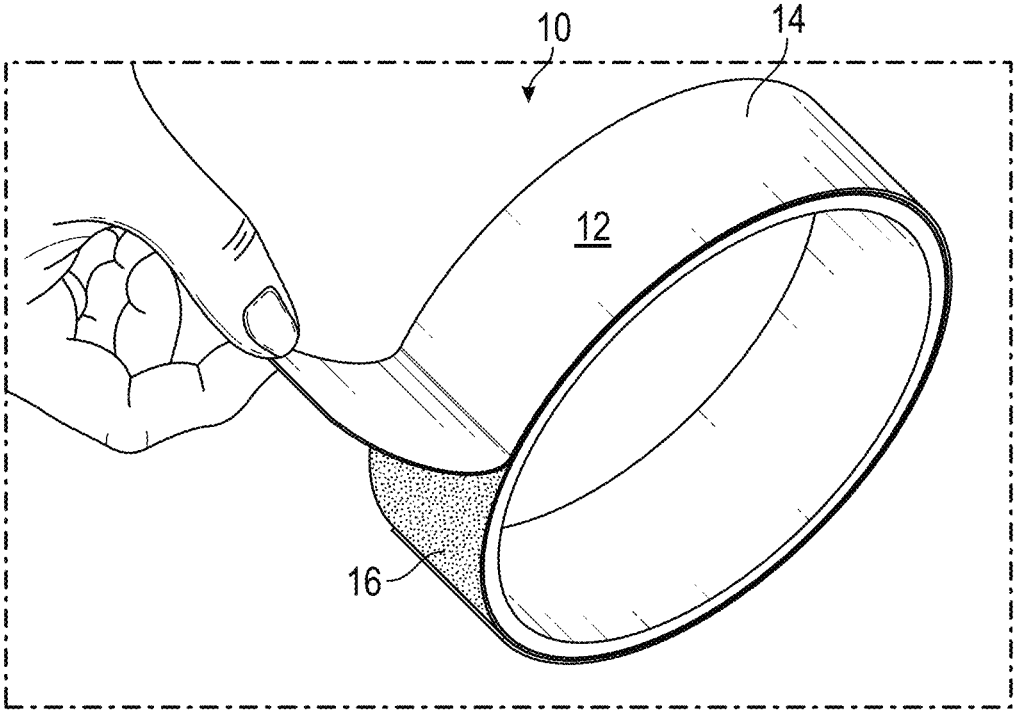
FIG. 3 is a perspective view of the bracelet FIG. 2 illustrating a user grabbing one end of the protective layer and removing the protective layer to expose the sticky outer surface of the bracelet.

As shown in FIG. 3, to use bracelet 10 the user pinches or grabs one end of the removable protective layer 12 and unpeels it from the outer surface 14 to expose the sticky material 16 on the outer surface 14. The removable protective layer 12 covers a substantial portion of the outer surface 14, where the word substantial is defined in this application as more than 50% of the outer surface area. In another embodiment the entire outer surface 14 is coated with the sticky material 16. Preferably, the user is a child which is defined in this application as a human age 12 and under.

Figure 4:
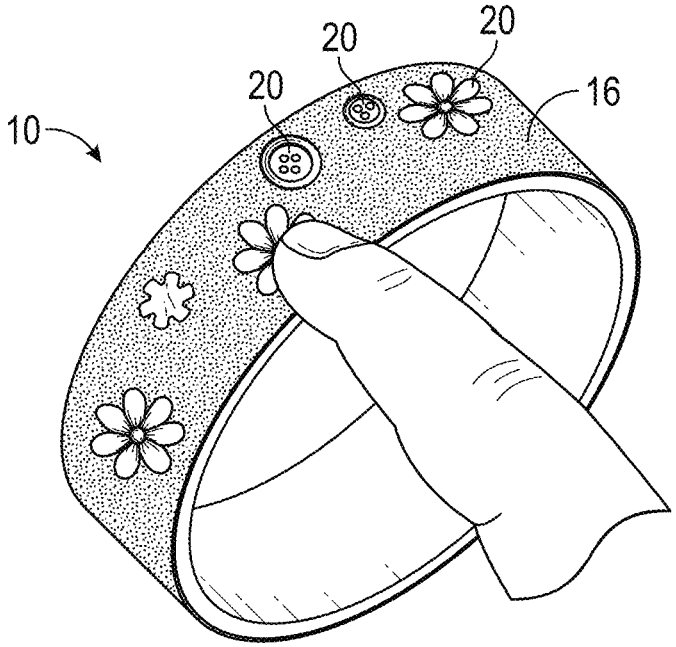
FIG. 4 is a perspective view of a user applying objects to the sticky outer surface to create a decorative bracelet.

As shown in FIG. 4, a user can selectively add small objects 20 to the sticky outer surface 14 to affix the objects 20 at selected locations on the outer surface 14 and customize the bracelet. The sticky material 16 encourages creativity by letting children stick different objects 20 to the bracelet 10, giving the freedom to create their unique accessories. The objects 20 can include small objects like flowers, trinkets, small toys, plastic jewels, buttons, ribbons or other tiny items to enable children (and adults) to personalize the bracelet. Bracelet 10 is inexpensive and may be packaged in a kit, such as a pouch or bag, including bracelet 10 and an assortment of objects to choose from. Bracelet 10 and the attached objects are disposable after use or even lost and provide entertainment to kids needing to focus on a project. During use by children the sticky surface 14 may attract dirt or hair which is no issue because the bracelet is disposable after use or when the child is no longer interested in the project.

Bracelet 10 can be decorated before being worn by a user, or when worn by the user. The outer surface 14 faces outwardly from the wrist and is exposed to ambient.

Figure 5:
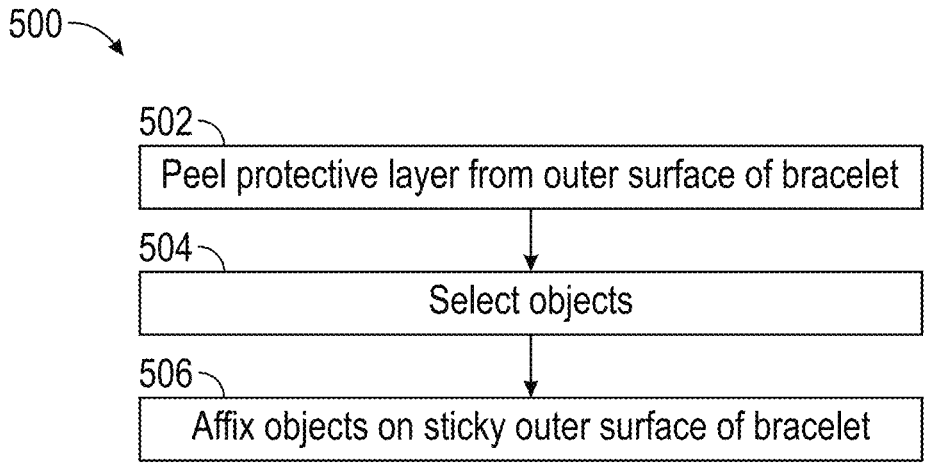
FIG. 5 is a method of creating a bracelet.

FIG. 5 is a method 500 for forming bracelet 10.

At step 502, a user peels the protective layer 12 from the bracelet 10 by pinching or grabbing the protective layer 12, such as an end of the protective layer 12 as shown in FIG. 3. By peeling and removing the protective layer 12 the sticky outer surface 14 is exposed to ambient.

At step 504, a user selects objects 20 to be affixed or applied to the sticky outer surface 14. The objects may be provided in a pouch or bag as part of a kit including the bracelet 10 or may be picked up from around the house or purchased separately.

At step 506, the user, such as a child, affixes the selected objects 20 on the sticky outer surface 14 as shown in FIG. 4. Objects 20 can be selectively attached on any portion of the exposed sticky outer surface 14 allowing the child to be creative and encourage participation and interest.

Figure 6:
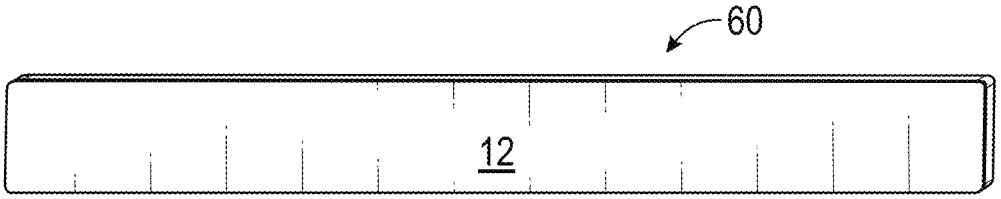
FIG. 6 illustrates an embodiment including an elongated strip laid flat.

FIG. 6 illustrates an embodiment including an elongated strip 60 laid flat and that includes an elongated layer 62 formed of plastic, paper, or an elastic member such as rubber or silicon and protective layer 12.

Figure 7:
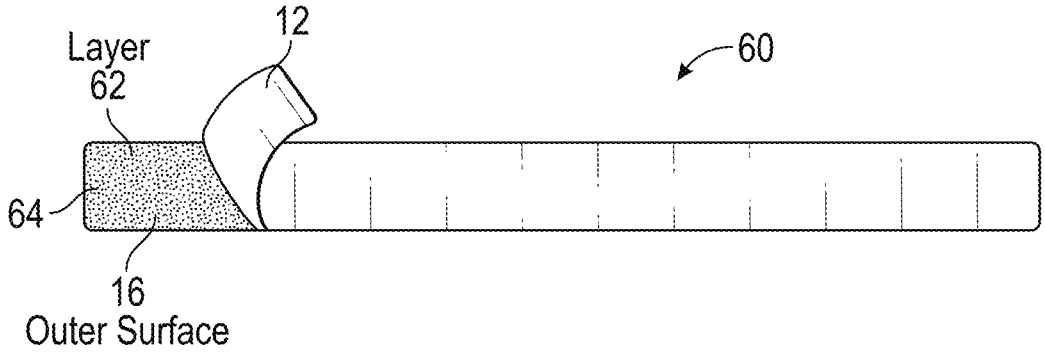
FIG. 7 illustrates the protective layer is selectively removable from layer by a user, such as by peeling, to expose outer surface having sticky material.

As shown in FIG. 7, the protective layer 12 is selectively removable from layer 62 by a user, such as by peeling, to expose outer surface 64 having sticky material 16.

Figure 8:
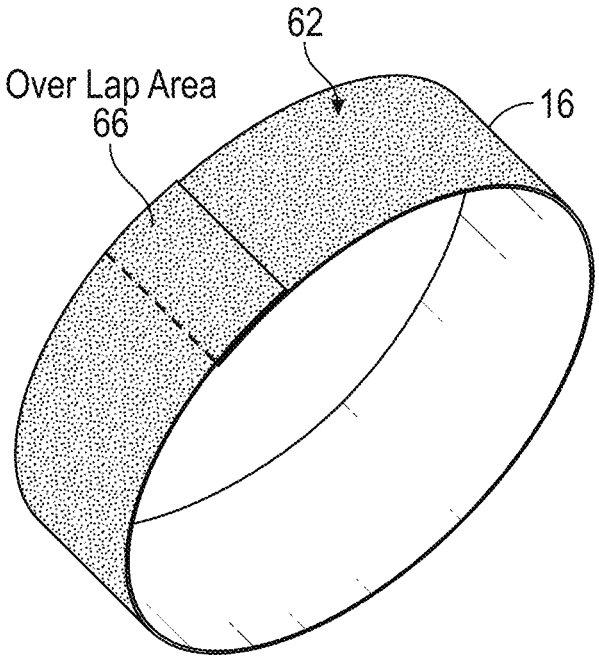
FIG. 8 illustrates the layer folded into an annular ring and secured to itself along a portion such that the outer surface including the sticky material is exposed.

FIG. 8 illustrates layer 62 folded into an annular ring and secured to itself along a portion 66 such that the outer surface 14 including sticky material 16 is exposed. Objects 20 can be affixed by the user to sticky material 16 of the outer surface 64 as previously shown and described in reference to FIG. 4 and FIG. 5.

The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described herein may also be combined or replaced by alternative features serving the same, equivalent, or similar purpose without departing from the scope of the invention defined by the appended claims.

What is claimed is:

1. A customizable bracelet, comprising:

a band configured to be disposed about a wrist of a user, the band having an outer surface;

an adhesive material disposed on the outer surface of the band;

a selectively removable protective member configured to be removed from the band and expose the adhesive material; and a plurality of objects configured to be selectively attached to the adhesive material by a user to create a customized bracelet, wherein the adhesive material covers a substantial portion of the outer surface.

2. The customizable bracelet of claim 1, wherein the band is a unitary annular member forming a ring.

3. The customizable bracelet of claim 1, wherein the adhesive material covers the entire outer surface.

4. The customizable bracelet of claim 1, wherein the protective material is configured to be peeled from the band by a hand of a user.

5. The customizable bracelet of claim 1, wherein the plurality of objects are aesthetically decorative.

6. The customizable bracelet of claim 1, wherein the objects are selected from the set of flowers, trinkets, toys, jewels, buttons, and ribbons.

7. The customizable bracelet of claim 1, wherein the outer surface is rectangular.

8. The customizable bracelet of claim 1, wherein the adhesive material is transparent.

9. The customizable bracelet of claim 1, wherein the protective member is comprised of a paper or plastic material.

10. A method of forming a customizable bracelet, comprising the steps of:

peeling a selectively removable protective member from an outer surface of a band having an outer surface including an adhesive material disposed on the outer surface of the band to expose the adhesive material, wherein the adhesive material covers a substantial portion of the outer surface, wherein the outer surface faces outwardly from the wrist; and attach a plurality of objects to the adhesive material.

11. The method of claim 10, further comprising the step of attaching the band to a wrist of a person.

12. The method of claim 10, wherein the user is a child.

13. The method of claim 10, wherein the adhesive material covers the entire outer surface.

14. The method of claim 10, wherein the protective material is peeled from the band by a hand of a user.

15. The method of claim 10, wherein the plurality of objects are aesthetically decorative.

16. The method of claim 10, wherein the objects are selected by the user from the set of flowers, trinkets, toys, jewels, buttons, and ribbons.

17. The method of claim 10, wherein the outer surface is rectangular.

18. The method of claim 10, wherein the protective member is comprised of a paper or plastic material.

* * * * *